US005839937A

United States Patent [19]

Thomas

[11] Patent Number: 5,839,937

[45] Date of Patent: Nov. 24, 1998

[54] PORTABLE MODEL RAILROAD

[76] Inventor: Richard Roy Thomas, 201 Serpentine La., Islandia, N.Y. 11722

[21] Appl. No.: 820,160

[22] Filed: Mar. 19, 1997

[51] Int. Cl.[6] ..... A63H 33/04; A63H 19/28; E01B 23/00

[52] U.S. Cl. ..... 446/75; 446/447; 238/10 A

[58] Field of Search ..... 446/75, 72, 71, 446/444, 446, 447; 104/DIG. 1, 53; 238/10 R, 10 A, 10 B, 10 C, 10 D, 10 E, 10 F

[56] References Cited

U.S. PATENT DOCUMENTS

| | | | |
|---|---|---|---|
| 1,914,116 | 6/1933 | Ford | 238/10 A X |
| 2,616,630 | 11/1952 | De Michele | 238/10 E X |
| 2,618,437 | 11/1952 | Mattaeis, Jr. | 238/10 A X |
| 2,998,196 | 8/1961 | Eeningenburg, Jr. | 238/10 E X |
| 3,025,626 | 3/1962 | Schumacher | 238/10 B |
| 3,352,054 | 11/1967 | Glass et al. | 238/10 E X |

FOREIGN PATENT DOCUMENTS

| | | | |
|---|---|---|---|
| 3300318 | 7/1984 | Germany | 238/10 B |

*Primary Examiner*—Robert A. Hafer
*Assistant Examiner*—D. Neal Muir

[57] ABSTRACT

A portable model railroad including a foldable enclosure comprised of a pair of tray members. The enclosure includes a hinge secured between interior edges of the tray members. A track system is removably secured to and extends around the pair of tray members. The track system is adapted to receive a model train thereon.

1 Claim, 2 Drawing Sheets

FIG 1
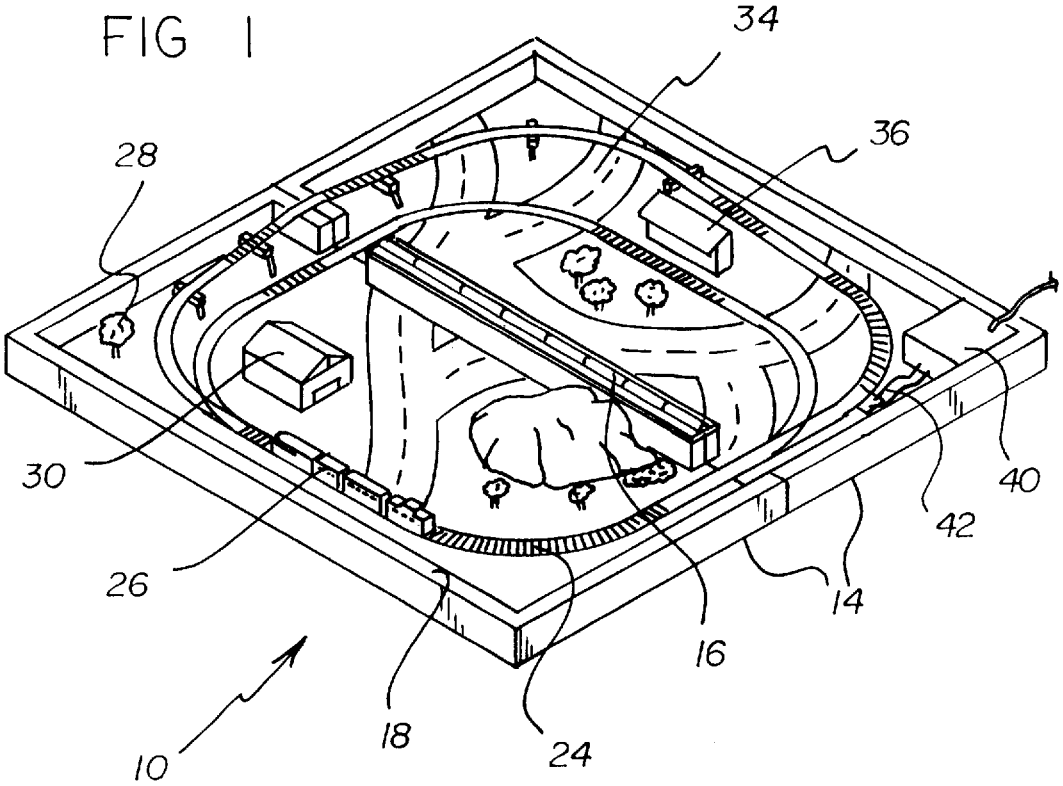
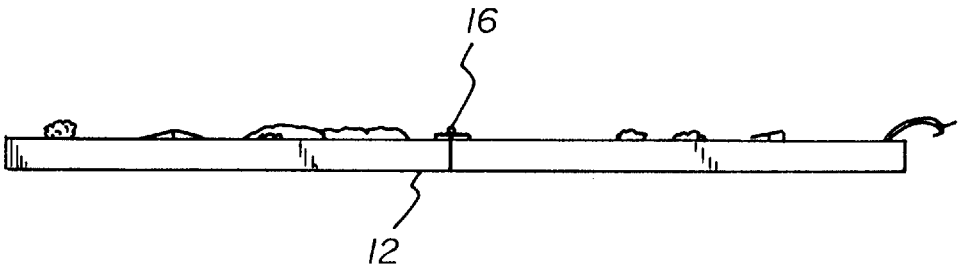
FIG 2

PORTABLE MODEL RAILROAD

BACKGROUND OF THE INVENTION

1. Field of the Invention

The present invention relates to a portable model railroad and more particularly pertains to providing portability, compact storage and easy set-up with a portable model railroad.

2. Description of the Prior Art

The use of model train boards is known in the prior art. More specifically, model train boards heretofore devised and utilized for the purpose of operating model trains are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,348,478 to Bradshaw discloses a modular terrain board.

U.S. Pat. No. 4,811,954 to Hemmann discloses a folding case and game board assembly.

U.S. Pat. No. Des. 325,758 to Black discloses the ornamental design for a model train track.

U.S. Pat. No. 4,193,211 to Dotsko discloses a modular terrain model board assembly and method of building same.

U.S. Pat. No. 4,051,783 to Caliri discloses a model railroad layout.

U.S. Pat. No. Des. 271,919 to Duffy discloses the ornamental design for a foldable display case.

While these devices fulfill their respective, particular objective and requirements, the aforementioned patents do not describe a portable model railroad for providing portability, compact storage and easy set-up.

In this respect, the portable model railroad according to the present invention substantially departs from the conventional concepts and designs of the prior art, and in doing so provides an apparatus primarily developed for the purpose of providing portability, compact storage and easy set-up.

Therefore, it can be appreciated that there exists a continuing need for new and improved portable model railroad which can be used for providing portability, compact storage and easy set-up. In this regard, the present invention substantially fulfills this need.

SUMMARY OF THE INVENTION

In the view of the foregoing disadvantages inherent in the known types of model train boards now present in the prior art, the present invention provides an improved portable model railroad. As such, the general purpose of the present invention, which will be described subsequently in greater detail, is to provide a new and improved portable model railroad and method which has all the advantages of the prior art and none of the disadvantages.

To attain this, the present invention essentially comprises a foldable enclosure comprised of a pair of tray members. The enclosure includes a hinge secured between interior edges of the tray members. Each of the tray members has an upwardly extending peripheral wall. One of the tray members has a U-shaped handle secured to an exterior edge thereof. A pair of cooperating locking members are disposed on the exterior edges of the tray members for closing the tray members in a folded orientation. A track system is removably secured to and extends around the pair of tray members. The track system is arrangable in a pair of concentric circles. The track system is adapted to receive a model train thereon.

Scenery and landscaping items are disposed on the pair of trays. The items include trees, houses, mountains, roads and a train station. A transformer is included that is adapted for coupling with an electrical outlet. The transformed has wiring coupled with the track system for operation of the model train thereon.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable model railroad which has all the advantages of the prior art model train boards and none of the disadvantages.

It is another object of the present invention to provide a new and improved portable model railroad which may be easily and efficiently manufactured and marketed.

It is a further object of the present invention to provide a new and improved portable model railroad which is of durable and reliable construction.

An even further object of the present invention is to provide a new and improved portable model railroad which is susceptible of a low cost of manufacture with regard to both materials and labor, and which accordingly is then susceptible of low prices of sale to the consuming public, thereby making such a portable model railroad economically available to the buying public.

Even still another object of the present invention is to provide a new and improved portable model railroad for providing portability, compact storage and easy set-up.

Lastly, it is an object of the present invention to provide a new and improved portable model railroad including a foldable enclosure comprised of a pair of tray members. The enclosure includes a hinge secured between interior edges of the tray members. A track system is removably secured to and extends around the pair of tray members. The track system is adapted to receive a model train thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the portable model railroad constructed in accordance with the principles of the present invention.

FIG. 2 is a side elevation view of the present invention.

The same reference numerals refer to the same parts through the various figures.

DESCRIPTION OF THE PREFERRED EMBODIMENT

With reference now to the drawings, and in particular, to FIGS. 1 through 4 thereof, the preferred embodiment of the new and improved portable model railroad embodying the principles and concepts of the present invention and generally designated by the reference number 10 will be described.

Specifically, it will be noted in the various Figures that the device relates to a portable model railroad for providing portability, compact storage and easy set-up. In its broadest context, the device consists of a foldable enclosure, a track system, scenery and landscaping items and a transformer. Such components are individually configured and correlated with respect to each other so as to attain the desired objective.

Figure 4:
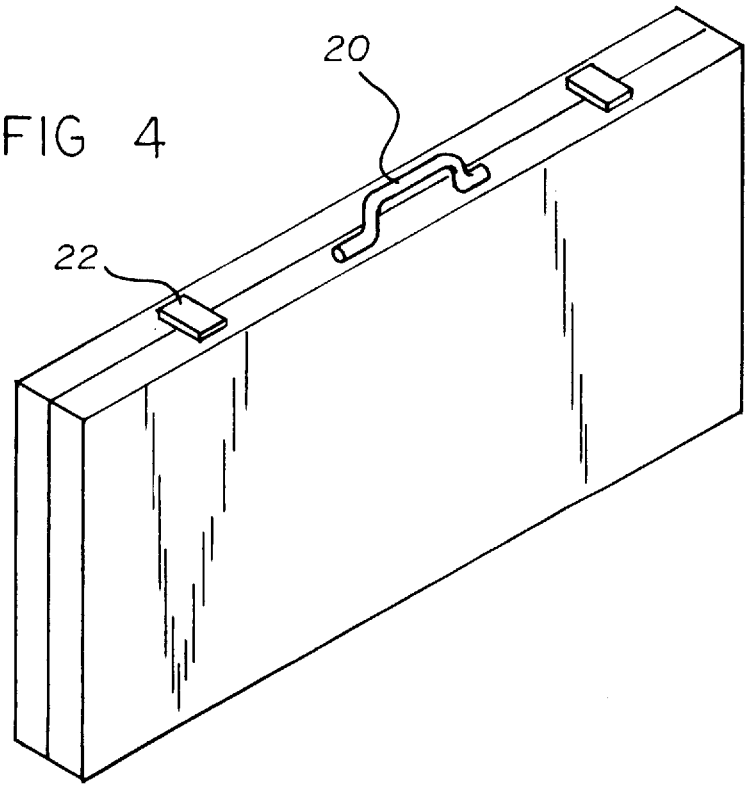
FIG. 4 is a perspective view of the present invention in a folded orientation.

The device 10 includes a foldable enclosure 12 comprised of a pair of tray members 14. FIG. 1 illustrates the foldable enclosure in its extended orientation where the pair of tray members are on the same plane. The enclosure includes a hinge 16 secured between interior edges of the tray members. The hinge allows for the pair of tray members to be folded in a closed and overlying position as shown in FIG. 4. Each of the tray members has an upwardly extending peripheral wall 18. In the folded orientation, the upwardly extending peripheral walls abut one another to contain any items within the foldable enclosure. One of the tray members has a U-shaped handle 20 secured to an exterior edge thereof. The U-shaped handle allows for the easy transportation of the device. A pair of cooperating locking members 22 are disposed on the exterior edges of the tray members for closing the tray members in a folded orientation. Alternate forms of closure means could also be provided for locking the foldable enclosure in the folded orientation.

Figure 3:
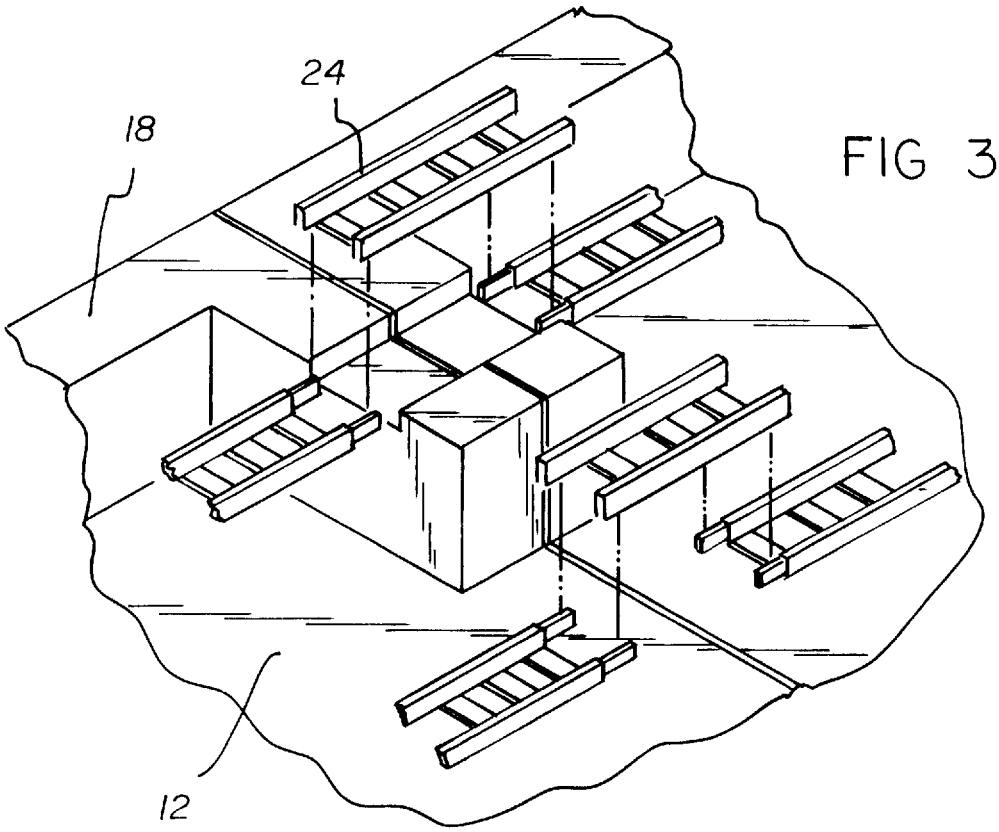
FIG. 3 is a fragmentary view of the removable tracks of the present invention.

A track system 24 that is fixedly attached to and extends around the pair of tray members. The track system may also be is removably secured to and extends around the pair of tray members. The track system having a removable arrangement is arrangable in a pair of concentric circles preferable, the track system is permanently attached to the tray member for quick and easy use. The track system is adapted to receive a model train 26 thereon. The track system can be broken down, as illustrated in FIG. 3, to allow for the tray members to be manipulated into the folded orientation. The track system can be built into the pair of tray members or could be made to allow for different patterns to be designed.

Scenery and landscaping items are disposed on the pair of trays. The items include trees 28, houses 30, mountains 32, roads 34 and a train station 36. The items should not be limited to those as mentioned above. The items could be permanently affixed to the trays or be movable to different locations on the trays.

A transformer 40 is included that is adapted for coupling with an electrical outlet. The transformer has wiring 42 coupled with the track system for operation of the model train thereon. The transformer allows for the operation of the model train around the track system. The device could include the transformer or allow for use with an existing transformer.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A portable model railroad assembly comprising, in combination:

a foldable enclosure being formed by a pair of tray members, each of the tray members having an upwardly extending peripheral wall with an elongated interior portion, the enclosure having a hinge secured between upper edges of the interior portions of the upper extending peripheral wall, one of the tray members having a U-shaped handle secured to an exterior edge thereof, a pair of cooperating locking members disposed on the exterior edges of the tray members for closing the tray members in a folded orientation;

a track system being fixedly attached to and extending around the pair of tray member, the track system adapted to receive a model train thereon, the track system including ends situated adjacent to an intersection of the tray members with male portions for receiving female Portions of an interconnect track when the tray members are in an open orientation;

scenery and landscaping items being fixedly disposed on the pair of trays, the items including trees, houses, mountains, roads and a train station; and a transformer secured to one of the tray members, the transformer adapted for coupling with an electrical outlet, the transformer having wiring coupled with the track system for operation of the model train thereon.

* * * * *